US007201368B2

(12) United States Patent
Tanigami et al.

(10) Patent No.: US 7,201,368 B2
(45) Date of Patent: Apr. 10, 2007

(54) SHEET FINISHER AND CONTROL METHOD THEREOF

(75) Inventors: Shinya Tanigami, Hachioji (JP); Masaru Ushio, Hachioji (JP); Kenichi Hosoi, Kawaguchi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/109,889

(22) Filed: Apr. 19, 2005

(65) Prior Publication Data

US 2006/0022395 A1 Feb. 2, 2006

(30) Foreign Application Priority Data

Aug. 2, 2004 (JP) ..... 2004-225297

(51) Int. Cl.
*B65H 37/04* (2006.01)

(52) U.S. Cl. ..... 270/58.11; 270/58.08; 270/58.09; 270/58.14; 399/408

(58) Field of Classification Search ..... 270/58.08, 270/58.11, 58.14, 58.09; 399/408; *B65H 37/04*
See application file for complete search history.

(56) References Cited

U.S. PATENT DOCUMENTS 4,424,963 A * 1/1984 Bartholet et al. ..... 270/58.13
5,114,130 A * 5/1992 Hamanaka et al. ..... 270/58.11
5,590,871 A * 1/1997 Okabe et al. ..... 270/58.27
5,639,080 A * 6/1997 Evans ..... 270/58.28
6,120,020 A * 9/2000 Asao ..... 271/189
2003/0219294 A1* 11/2003 Yoshimura et al. ..... 399/408
2004/0178572 A1* 9/2004 Nishimura et al. ..... 271/298

FOREIGN PATENT DOCUMENTS

JP 05-105308 4/1993
JP 07-089259 4/1995
JP 09-240909 9/1997

* cited by examiner

*Primary Examiner*—Gene O Crawford
*Assistant Examiner*—Leslie A. Nicholson, III
(74) *Attorney, Agent, or Firm*—Frishauf, Holtz, Goodman & Chick, P.C.

(57) ABSTRACT

A sheet finisher includes: a sheet stacker for stacking sheets outputted from an image forming apparatus to form a sheet bundle; a binder for binding the sheet bundle stacked on the sheet stacker; an ejection device for ejecting out of the sheet finisher at least one of the sheet bundle stacked on the sheet stacker and the sheet bundle which has been bound; an ejection tray for stacking the ejected sheet bundle or the bound sheet bundle sequentially; and a controller for controlling the ejection device to make the bound sheet bundle to wait on the sheet stacker, to make a sheet outputted from the apparatus which have not been bound to stack sequentially on the bound sheet bundle, and to make the bound sheet bundle and the sheet stacked on the bound sheet bundle as a unit to eject to the ejection tray.

8 Claims, 7 Drawing Sheets

SHEET FINISHER AND CONTROL METHOD THEREOF

This application claims priority from Japanese Patent Application No. 2004-225297 filed on Aug. 2, 2004, which is incorporated hereinto by reference.

BACKGROUND OF THE INVENTION

The present invention relates to a sheet finisher and control method thereof, wherein the sheet finisher that receives a sheet with an image formed thereon by an image forming apparatus such as a copier and printer, applies a process of binding to the sheet by means of a binding device, and ejects the sheet to an ejection tray.

In a sheet finisher, the sheets with images formed thereon by an image forming apparatus are stacked by a predetermined stacking means and are formed into a bundle of sheets, which are then provided with a process of binding to create a booklet or a document. This sheet finisher is widely used as a peripheral apparatus connected with an image forming apparatus.

Further, the disclosed sheet finishers include the apparatus provided with a punching means for punching the sheets having been stacked by the stacking means, similarly to the process of binding or stapling the sheets. (Patent Document 3)

A frequently used means for binding a sheet bundle includes a means that uses an apparatus called a stapler for binding the ends of the sheet bundle with a wire staple, and a means for binding by heating the binding tape coated with hot melt type paste and bringing it in contact with the side edge of the sheet bundle (e.g. Patent Document 1).

However, the work performed by a user using the image forming apparatus connected with a sheet finisher having the aforementioned binding means further contains the work of applying a process of binding, and the work of simply ejecting the sheets with images formed thereon, to an ejection tray and stacking them, without applying the process of binding.

The sheet finisher is provided with a sheet conveyance path for leading the sheets coming out of an image forming apparatus to a binding means and then leading the bound sheet bundle to an ejection tray, and a sheet conveyance path for leading the aforementioned sheets directly to the ejection tray, without feeding the sheets to the binding means. Two sheet conveyance paths arranged in such an apparatus causes increased costs and discourages downsizing of the apparatus. For this reason, a proposal has been made to integrate two sheet conveyance paths into device (e.g. Patent Document 2)

Integrating the sheet conveyance paths into one necessarily results in the arrangement of only the sheet conveyance path for leading the sheet to the binding means. In this case, a means of switching the sheet conveyance path is arranged in the vicinity of the binding means. The sheet conveyance path for applying the process of binding and the sheet conveyance path not intended to apply the process of binding are switched in response to the requirements.

In the sheet finisher arranged in the aforementioned configuration, if the work where binding is performed alternates with the work where it is not performed, the bound sheet bundle is ejected to the ejection tray every time binding has completed. After the sheet conveyance path has been switched, the apparatus handles the next process where binding is not performed. Such an operation cycle is repeated. The switching operation frequently repeated drastically reduces the processing capability of the sheet finisher, with the result that the image forming apparatus is placed in the operation wait status more frequently.

Patent Document 1 denotes Official Gazette of Japanese Patent Application Tokkaihei 7-89259, Patent Document 2 denotes Official Gazette of Japanese Patent Application Tokkaihei 9-240909, and Patent Document 3 denotes Official Gazette of Japanese Patent Application Tokkaihei 5-105308.

SUMMARY OF THE INVENTION

The present invention is intended to avoid reduction of the processing capacity of a sheet finisher as described above. The object of the present invention is to provide a sheet finisher wherein a sheet bundle not having been subjected to the process of binding is stacked on a sheet bundle having been subjected to the process of binding, and these sheet bundles are integrated into one bundle, which is ejected to the ejection tray, thereby minimizing the frequency of switching a sheet conveyance path.

The aforementioned object can be achieved by implementing any one of the Items (1) through (4) described below.

(1) A sheet finisher comprising: a sheet stacking means for stacking the sheets outputted from an image forming apparatus to form a sheet bundle; a binding means for binding the sheet bundle stacked on the aforementioned sheet stacking means; an ejection means for ejecting out of the sheet finisher the sheet bundle stacked on the sheet stacking means or the sheet bundle having been subjected to the process of binding; and an ejection tray for stacking the ejected sheet bundle or bound sheet bundle sequentially.

In this sheet finisher, a sheet bundle having been subjected to the process of binding is made to wait on the sheet stacking means, and the sheet, not having been subjected to the process of binding, coming out of the image forming apparatus is placed on the sheet bundle in the wait state. This sheet finisher further comprises a control means that control the ejection means in such a way that the sheet bundle and sheets placed on the sheet bundle are integrated as one bundle and are ejected to this ejection tray.

(2) The sheet finisher described in Item (1) wherein the aforementioned control means controls the aforementioned ejection means in such a way that, before the first sheet of the next sheet bundle to be subjected to the process of binding reaches the aforementioned sheet stacking means, the sheet bundle, having been subjected to the process of binding, stacked on the sheet stacking means, and the sheet placed on the aforementioned sheet bundle are integrated into one bundle, and are ejected to the ejection tray.

(3) The sheet finisher described in Item (1) wherein a stacking amount detecting means is provided detect to see whether or not the amount of the paper stacked on the sheet stacking means has reached the permissible maximum amount to be stacked; and upon receipt of detection information from the stacking amount detecting means, the control means controls the ejection means in such a way that the sheet bundle, having been subjected to the process of binding, stacked on the sheet stacking means, and the sheet placed on the aforementioned sheet bundle are integrated into one bundle, and are ejected to the ejection tray.

(4) A control method for a sheet finisher comprising the steps of: stacking on a sheet stacking means the sheets outputted from an image forming apparatus to form a sheet bundle; binding the sheet bundle stacked on the aforementioned sheet stacking means by means of a binding means;

ejecting out of the sheet finisher the sheet bundle stacked on the sheet stacking means or the sheet bundle having been subjected to the process of binding by means of an ejection means; and stacking the ejected sheet bundle or bound sheet bundle sequentially to an ejection tray.

In this control method, a sheet bundle having been subjected to the process of binding is made to wait on the sheet stacking means, and the sheet, not having been subjected to the process of binding, coming out of the image forming apparatus is placed on the sheet bundle in the wait state. Control is provided in such a way that the sheet bundle and sheets are integrated as one bundle and are ejected to this ejection tray by the ejection means.

The Item (1) reduces the frequency of switching the sheet conveyance path of the sheet finisher and minimizes reduction in the processing performances of a system composed of the image forming apparatus and sheet finisher. Further, the sheet bundle having been subjected to the process of binding and the sheet bundle not having been subjected to the process of binding constitutes one part. This part constituted in this manner is handled as one body and is ejected to the ejection tray. Such functions of the sheet finisher are provided by the Item (1).

According to the Item (2), before the first sheet of the next sheet bundle to be subjected to the process of binding reaches the aforementioned sheet stacking means, the sheet bundle stacked on the sheet stacking means is ejected from the sheet stacking means. This arrangement provides a reliable way of ensuring the next process of binding to be performed by a finishing means.

The Item (3) avoids stacking of sheet bundles in excess of the maximum stacking capability of the sheet stacking means. This arrangement avoids incorrect binding or ejection of the sheet bundles.

The Item (4) reduces the frequency of switching the sheet conveyance path of the sheet finisher and minimizes reduction in the processing performances of a system composed of the image forming apparatus and sheet finisher. Further, the sheet bundle having been subjected to the process of binding and the sheet bundle not having been subjected to the process of binding constitutes one part. This part constituted in this manner is handled as one body and is ejected to the ejection tray. A control method of a sheet finisher having such functions is provided by the Item (4).

DETAILED DESCRIPTION

The following describes the embodiments of the present invention with reference to drawings.

Figure 1:
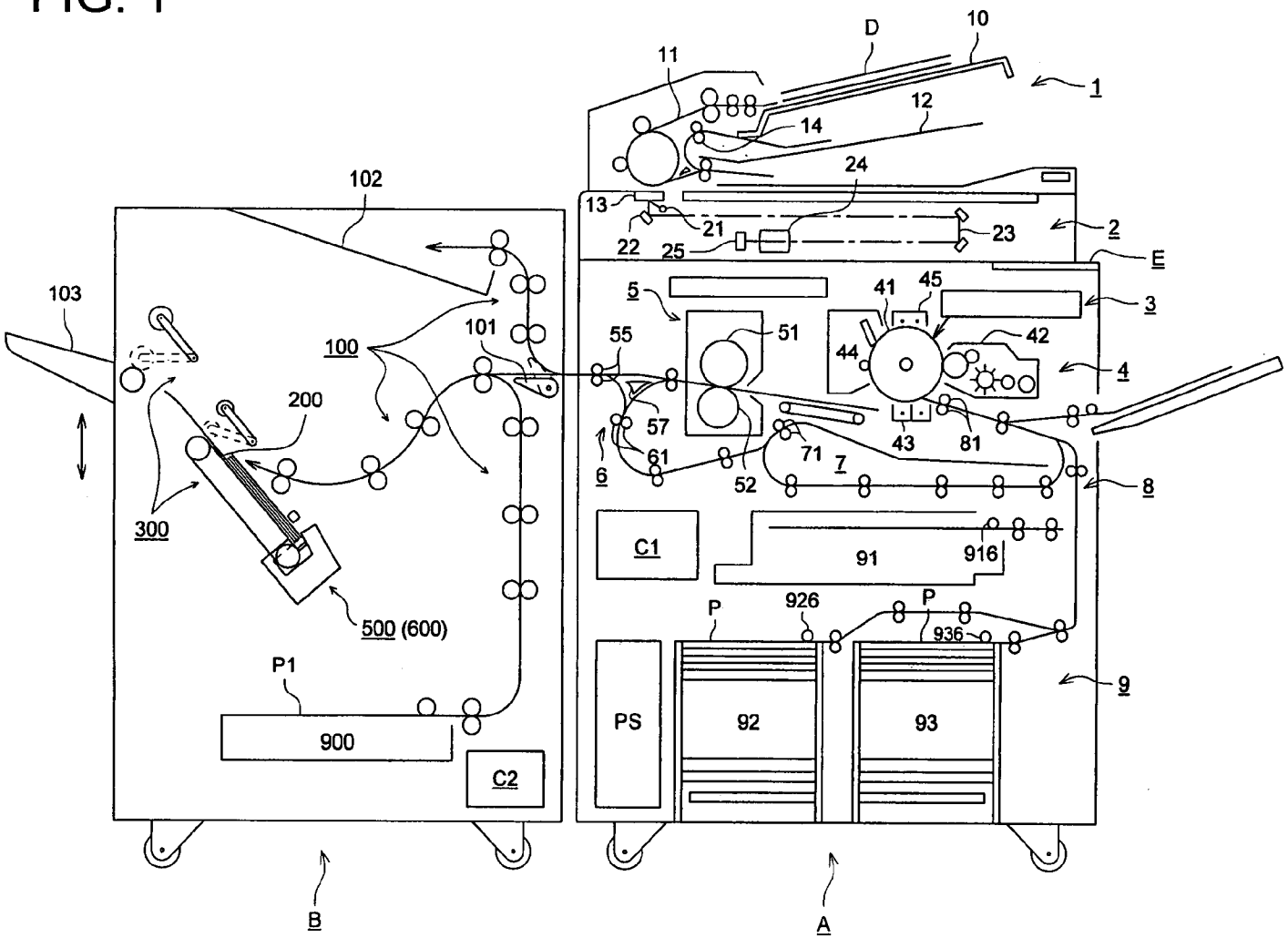
FIG. 1 is a conceptual diagram representing an image forming system.

FIG. 1 is a conceptual diagram representing an image forming system wherein the sheet finisher and image recording apparatus are connected with each other.

The image forming apparatus A is a digital copying machine for forming an image using a known electrophotographic technology. An automatic document feeder 1 is installed on the top of the image forming apparatus A, which is connected with a sheet finisher B.

The image forming apparatus A comprises an automatic document feeder 1, a reading means 2, a writing means 3, an image forming means 4, a fixing means 5, a reversing or ejecting means 6, a re-feeding means 7, a sheet conveyance means 8, a sheet feeding means 9, a control means C1 and an operation and display means E.

The automatic document feeder 1 ensures that the documents D placed on the document platen 10 are fed one by one to a document conveyance path 11, and so that the documents are ejected to a document ejection platen 12. The image surface of the document D which is being carried is read by the reading means 2 at the document reading position 13. When the images on both sides of the document D are read, the document D whose first side has been read is reversed by a reversing means 14, is sent again to the document conveyance path 11 whose second side is read, is then ejected to the document ejection platen 12.

The reading means 2 comprises a light source 21, a first mirror unit 22, a second mirror unit 23, image forming lens 24, and a CCD (charge-coupled device) 25. Scanning the image of the documents D passing through the document reading position 13, the rading neans 2 allows the image to be formed on the CCD 25, and converts the document image information as optical information into electrical information. The document image information donverted in this manner is subjected to A/D conversion, shading correction and compression, and is stored in the memory M1 of the control means C1.

The writing means 3 is a scanning optical system composed of a laser light source, cylindrical lens, an Fθ lens, a mirror and a polygon mirror. Using the laser beam changing in response to the image information read from the aforementioned memory M, the writing means 3 scans the surface of the photoconductor 41 of the image forming means 4, and forms a latent image on the surface of the photoconductor 41.

The image forming means 4 uses a development means 42 to develop a latent image formed on the surface of a photoconductor 41 so that the latent image is turned into a toner image. By a transfer means 43, the toner image is transferred on the sheet P fed out by a registration roller 81. The residual toner is removed by a cleaning means 44 from the surface of the photoconductor with the toner image having been transferred. It is electrically charged by a charging means 45 and is used in the next process of forming a latent image.

The fixing means 5 applies heat and pressure to the sheet P carrying a toner image, by means of a heat roller 51 and a pressure roller 52 arranged opposite thereto. Then the toner image is fixed onto the sheet P.

The sheet P with an image having been fixed thereon is sent to the sheet finisher B by an ejection roller 55.

When the sheet P is reversed and ejected, the sheet P is led downward by an ejection guide 57 and the trailing edge of the sheet P is pinched between reversing rollers 61 of the reversing means. Then the sheet P is reversed and is fed out to the ejection roller 55.

When an image is formed on both sides of the sheet P, the sheet P is fed to the re-feeding means 7 by the ejection guide 57 and a plurality of rollers. The sheet P is reversed by the reversing roller 71 and is fed again to the sheet conveyance means 8.

The sheet conveyance means 8 conveys the sheet P fed out of the sheet feeding means 9 along the conveyance path containing a plurality of rollers and guide member. After the leading edge of the sheet P has contacted the registration roller 81, the sheet conveyance means 8 feeds out to the photoconductor 41 for receiving the toner image.

The sheet feeding means 9 comprises a first sheet feed means 91 containing a small-capacity tray, a second sheet feed means 92 containing a large-capacity tray, and a third sheet feed means 93. These sheet feed means are provided with feeding rollers 916, 926 and 936 for feeding the sheets P mounted on each tray one by one to the sheet conveyance means 8. The second sheet feed means 92 and third sheet feed means 93 are provided with a top surface detecting means for detecting the top surface position of the stacked sheets. According to the top surface detection signal from this top surface detecting means, the control means C1 vertically moves the bottom of the tray carrying the sheet P.

The operation and display means E has both the display and input functions, using the touch panel installed on the top surface of the image forming apparatus A. It is employed by the user to input an operation command to the control means C1, including the cases of setting the number of the copies to be taken, or setting whether or not the outputted copies are subjected to the process of finishing.

The sheet finisher B comprises a distribution guide 101, a sheet conveyance means 100 containing a plurality of rollers and guide members, an intermediate stacker 200 as a sheet stacking means for stacking sheets P and forming a sheet bundle, a binding means 500 for binding the aforementioned sheet bundle (a punching means 600 for punching the sheet bundle may be additionally provided), an ejection means 300 for ejecting the sheet bundle on the intermediate stacker, an ejection tray 103 for stacking the ejected sheet bundles sequentially, an ejection platen 102 for stacking a small quantity of paper, a sheet stacking means 900 and a control means C2.

When the user has operated the operation and display means E to select the mode where finishing is not performed, and to select a small quantity of sheets, then the sheet P, with an image formed by the image forming apparatus A, having been fed to the sheet finisher B, is led upward by the first sheet member 101. The sheet P is then ejected to the ejection platen 102 by the sheet conveyance means 100.

When the user has selected to the mode where finishing is performed or has set the output of the sheet P in excess of the preset quantity, the sheet P is led downward to the intermediate stacker 200 by the first sheet member 101.

The sheet finisher B of the present invention is also capable of placing the cover or the sheet P1 to be inserted between pages on a sheet accommodation means 900, and feeding out the accommodated sheet P1 to the intermediate stacker 200 so that it will be located within the page position of the sheet P fed from the image forming apparatus A.

Figure 2:
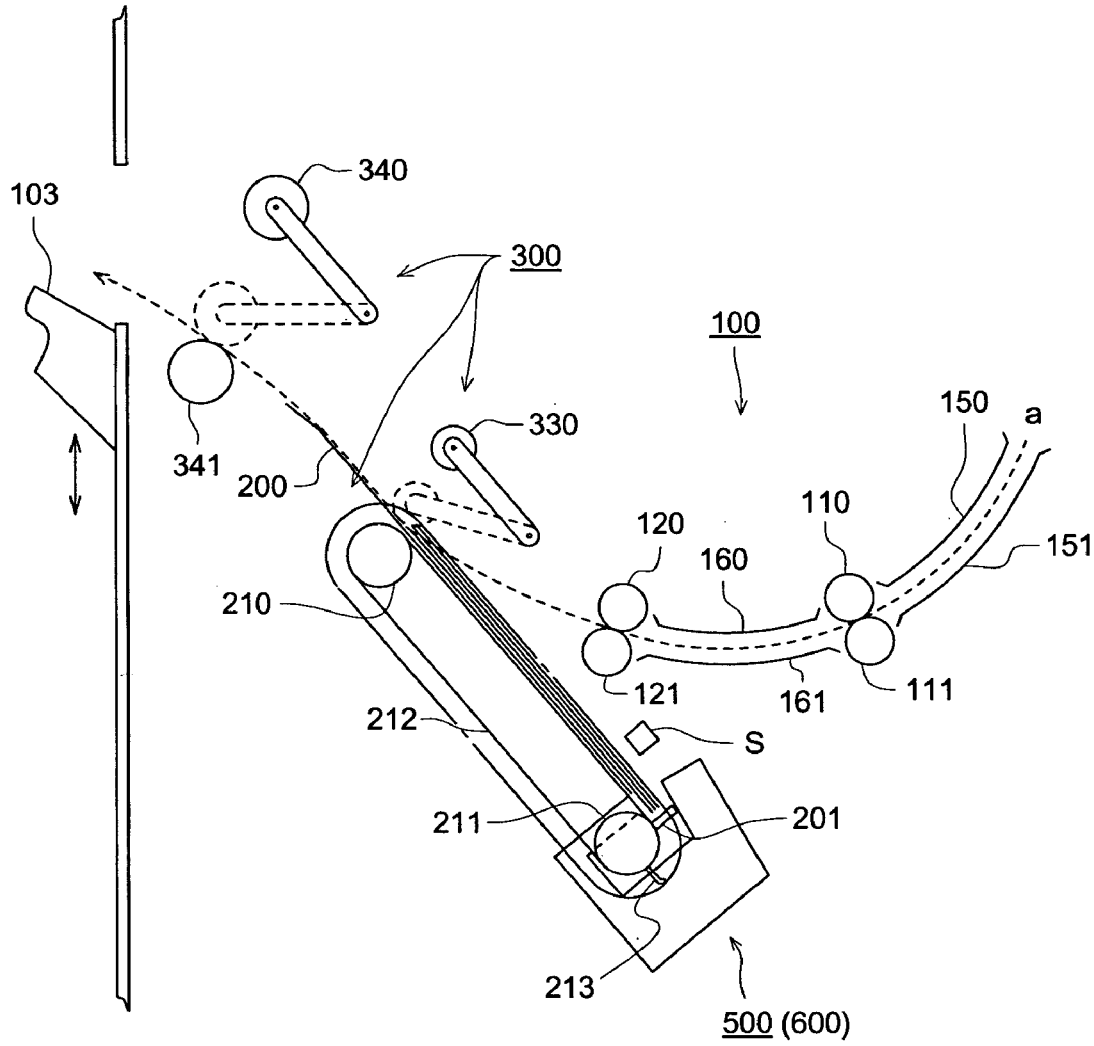
FIG. 2 is a conceptual diagram representing the vicinity of an intermediate stacker.

FIG. 2 is a conceptual diagram representing the vicinity of an intermediate stacker 200.

The sheet P fed from the right (a) of the drawing is conveyed to the intermediate stacker 200 by a plurality of conveyance rollers 110, 111, 120 and 121 constituting the sheet conveyance means 100 and a plurality of guide members 150, 151, 160 and 161. This intermediate stacker 200 is a is a plate-formed member held to have an angle of about 45 degrees relative to the horizontal plane.

When the sheet P is to be ejected directly to the ejection tray 103, without being stacked on the intermediate stacker 200, the first ejection roller 330 and the second ejection roller 340 move to the position indicated by the dotted line. The sheet P is fed and ejected to the ejection tray 103.

The ejection means 300 comprises a first ejection roller 330 whose position is controlled by the control means C2, a second ejection roller 340, a drive pulley 210, a driven pulley 211, an ejection belt 212, an ejection claw 213, a plurality of rollers and guide members.

When the sheet P is stacked on the intermediate stacker 200, the first ejection roller 330 is kept at the position of the solid line in the drawing. The sheet P whose trailing edge has separated from the conveyance rollers 120 and 121 on the intermediate stacker 200 slips down along the intermediate stacker surface. The trailing edge collides with the contact member 201 and the movement is stopped. The next sheets P having been fed out slip down and sequentially stacked on the sheet P having been fed previously, with the trailing edges kept in alignment. The position of the sides of the sheet is regulated by the side guides (not illustrated) arranged on the side of the intermediate stacker 200. To be more specific, the edges of the sheets P are kept in alignment by the contact member 201 and side guides, and these sheets P are stacked on the intermediate stacker 200.

If the number of the bundles of the sheets P stacked on the intermediate stacker 200 increases, and the load exceeds the permissible maximum stacking capacity of the intermediate stacker 200, this situation is detected by the stacking amount detecting means S. When the top surface of the stacked sheets P has been detected by the stacking amount detecting means S, the outputting of the sheets P from the image forming apparatus A is suspended and the sheets P stacked on the intermediate stacker 200 are ejected to the ejection tray 103.

When the process of binding is applied to the sheet bundle as sheets P stacked on the intermediate stacker 200, the process of binding is carried out by the binding means 500. The binding means of the present invention is a commonly known means called the stapler wherein the sheet bundle is bound by a wire staple. An adequate means other than the stapler can be used as the binding means 500.

A notch is formed on part of the sheet stacking surface of the intermediate stacker 200, the drive pulley 210 and driven pulley 211 constituting the ejection means 300, and a plurality of ejection belts 212 turned by these pulleys are rotatably arranged. Part of the ejection belt 212 is provided with the ejection claw 213. Its tip generates an elliptical locus, as indicated by a one-dot chain line in the drawing.

The end of the sheet bundle, with one of the ends bound by the binding means 500, is held by the ejection claw 213 moved by the rotation of the ejection belt 212. While slipping down sheet stacking surface of the intermediate stacker 200 is pushed obliquely upward, the sheet bundle is pinched between the rotating second ejection rollers and is ejected to the ejection tray 103.

The ejection tray 103 is a well known tray for sequentially stacking the sheets P ejected by the second ejection rollers 340 and 341 or the sheet bundles having been subjected to the process of binding. It is vertically movable, and is controlled in such a way that the top surfaces of the stacked sheets P or sheet bundles are located always at a constant position.

In the aforementioned sheet finisher B, if the process where finishing is not performed is carried out following the process where finishing is performed, then the sheet bundle having been subjected to the process of binding is ejected first. Then the positions of the first ejection roller 330 and second ejection roller 340 are shifted to the sheet-P conveyance position (indicated by the dotted line in the drawing). During this process of ejection and the process of switching the sheet conveyance path by the roller position shift, outputting of the sheets P from the image forming apparatus A is disabled. Thus, the image forming apparatus A is placed in the wait mode. Consequently, if switching of the process is performed frequently, the throughput of the system composed of the image forming apparatus A and sheet finisher B will be reduced. This creates a problem.

Figure 7:
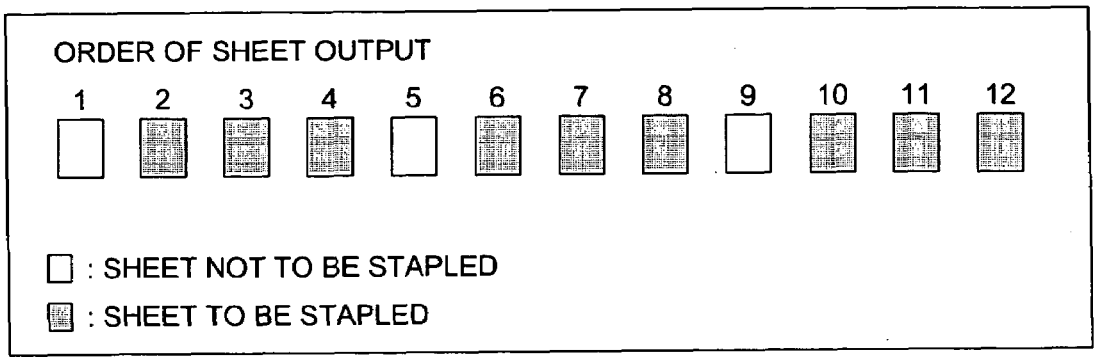
FIG. 7 is a chart showing an example of an output of sub-set stapling function (or sheet bundle division function).

A procedure of repeating alternately the process with binding and the process without binding is exemplified by a function called a subset binding function. In the subset binding function, one set of sheets is divided into plural subsets including at least one sheet and at least one sheet bundle which is subjected to binding, and is outputted. An example of the output is shown in FIG. 7. In the example, one set of sheets is composed of one sheet not to be bound and three sheets to be bound, and three sets of sheets are outputted. This example includes a total of three steps of switching from a non-binding mode to a binding mode for locations between $1^{st}$ and $2^{nd}$ sheets, between $5^{th}$ and $6^{th}$ sheets, and between $9^{th}$ and $10^{th}$ sheets; and a total of two steps of switching from the binding mode to the non-binding mode for locations between $4^{th}$ and $5^{th}$ sheets, and between $8^{th}$ and $9^{th}$ sheets. In the subset binding function, the operation throughput is much reduced by a great number of the switching operations, as described above.

Further, similarly to the process of binding, a procedure of repeating alternately the process with punching and the process without punching is exemplified by a function called a subset punching. In the subset punching function, one set of sheets is divided into plural subsets including at least one sheet and at least one sheet bundle which is subjected to punching, and is outputted (not illustrated). Similarly to the case shown in FIG. 7, one set of sheets is composed of one sheet not to be punched and three sheets to be punched, and three sets of sheets are outputted. This example includes a total of three steps of switching from a non-punching mode to a punching mode for locations between $1^{st}$ and $2^{nd}$ sheets, between $5^{th}$ and $6^{th}$ sheets, and between $9^{th}$ and $10^{th}$ sheets; and a total of two steps of switching from the punching mode to the non-punching mode for locations between $4^{th}$ and $5^{th}$ sheets, and between $8^{th}$ and $9^{th}$ sheets. In the subset punching function, the operation throughput is much reduced by a great number of the switching operations, as described above.

Figure 3:
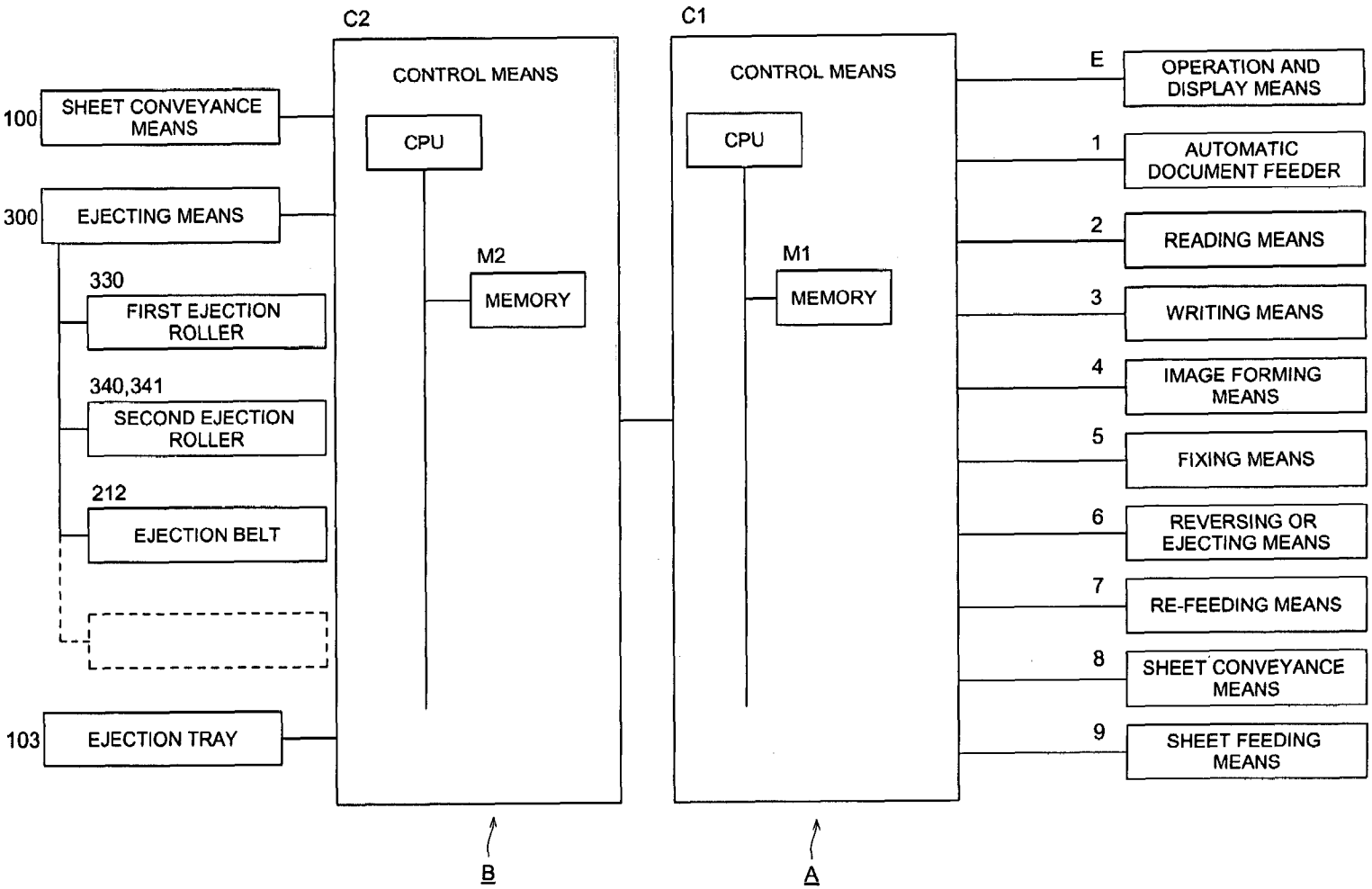
FIG. 3 is a block diagram representing the control of an image forming apparatus.

In the present invention, when the process where finishing is not performed is carried out following the process where finishing is performed, then the sheet bundle without having been subjected to the process of binding is formed on the bound sheet bundle formed on the intermediate stacker 200. These sheet bundles are integrated into one bundle, which is ejected. This control reduces the aforementioned frequency of switching and avoids reduction of the throughput of the system composed of the image forming apparatus A and sheet finisher B. The following provides a detailed description with reference to the block diagram and flowchart:

FIG. 3 is a block diagram representing the control of an image forming system composed of the image forming apparatus A and sheet finisher B.

The control means C1 of the image forming apparatus A is a computer system formed of a CPU, a microprocessor, a memory M1, an input and output interface I/F, a communication means, a drive circuit and others. The image forming apparatus A controls each means by executing the program stored in the memory M1 in advance. Further, the control means C2 of the sheet finisher is smaller in size than the control means C1, but has the same configuration. The control means C2 exchanges information with the control means C1 using a serial communication means. It should be noted that this drawing, does not contain the block not required for the explanation of the embodiment of the present invention.

Figure 4:
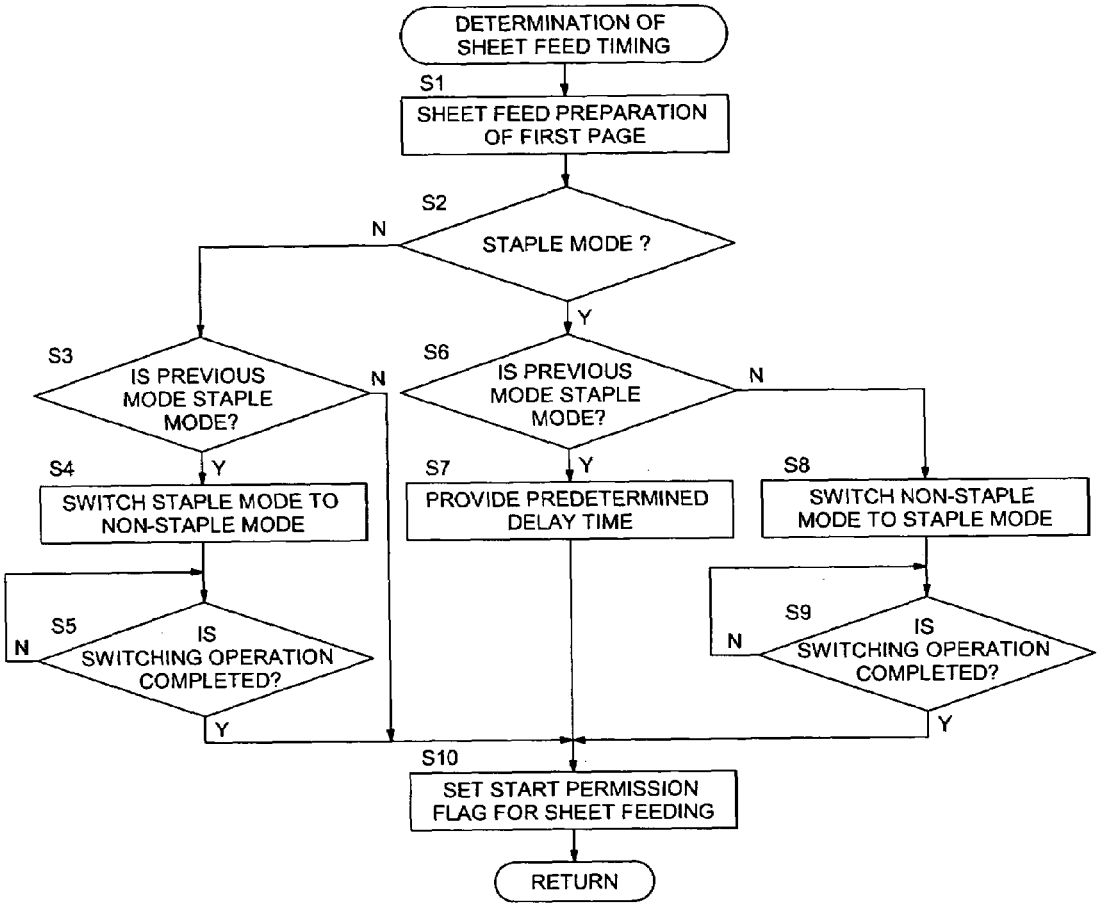
FIG. 4 PRIOR ART
FIG. 4 is a flowchart showing the determination of sheet feed timing according to the prior art.

FIG. 4 is a flowchart showing the flow of switching between the mode where binding is performed (hereinafter referred to as "staple mode") and the mode where binding is not performed (hereinafter referred to as "non-staple mode") in the prior art sheet finisher B, and the flow of determining the sheet feed timing.

When the leading edge of the sheet P as the first page for a certain process has reached the registration roller 81 of the image forming apparatus A (Step S1), evaluation is made to see whether or not the staple mode is selected to perform the finishing process applied to the sheets P (Step S2). If the staple mode is not selected (N in Step S2), evaluation is made to determine whether or not the mode of previous processing is a staple mode (Step S3).

If the mode of the previous processing is not the staple mode (N in Step S3), it shows a continuation of the non-staple mode. A sheet feed start permission flag is set. This flag serves as a mark indicating permission for starting the feed of the sheets P in the wait mode (Step S10). This sheet feed start permission flag is referenced during execution of the program for controlling the sheet conveyance means 8.

If the mode of the previous mode is the staple mode (Y in Step S3), the ejection rollers 330 and 340 are shifted to predetermined positions in order to meet the next non-staple mode (Step S4), after the sheet bundle having been stapled is ejected to the ejection tray 103. Upon confirmation of the termination of switching operation in response to the mode change (Y in Step S5), the aforementioned sheet feed start flag is set (Step S10).

If the staple mode is selected (Y in Step S2) in the evaluation of Step S2, evaluation is made to determine whether the mode of the previous processing is the staple mode or not (Step S6). If the previous mode is also the staple mode (Y in Step S6), the sheet feed start flag is set (Step S10) so that the delay time is provided (Step S7) to determine sheet feed timing. In this case, this sheet feed timing is determined in such a way that the leading page of the next processing reaches the intermediate stacker 200 after the stapled sheet bundle is ejected to the ejection tray 103.

If the non-staple mode is selected (N in Step S6) in the evaluation of Step S6, the ejection rollers 330 and 340 are shifted to predetermined positions in order to meet the next non-staple mode (Step S8).

Upon confirmation of the termination of switching operation in response to the mode change (Y in Step S9), the aforementioned sheet feed start flag is set (Step S10).

The above description refers to the operation of the prior art sheet finisher B. It can be seen that an increase in the frequency of mode switching operations leads to a longer sheet feed wait time of the image forming apparatus A.

Figure 5:
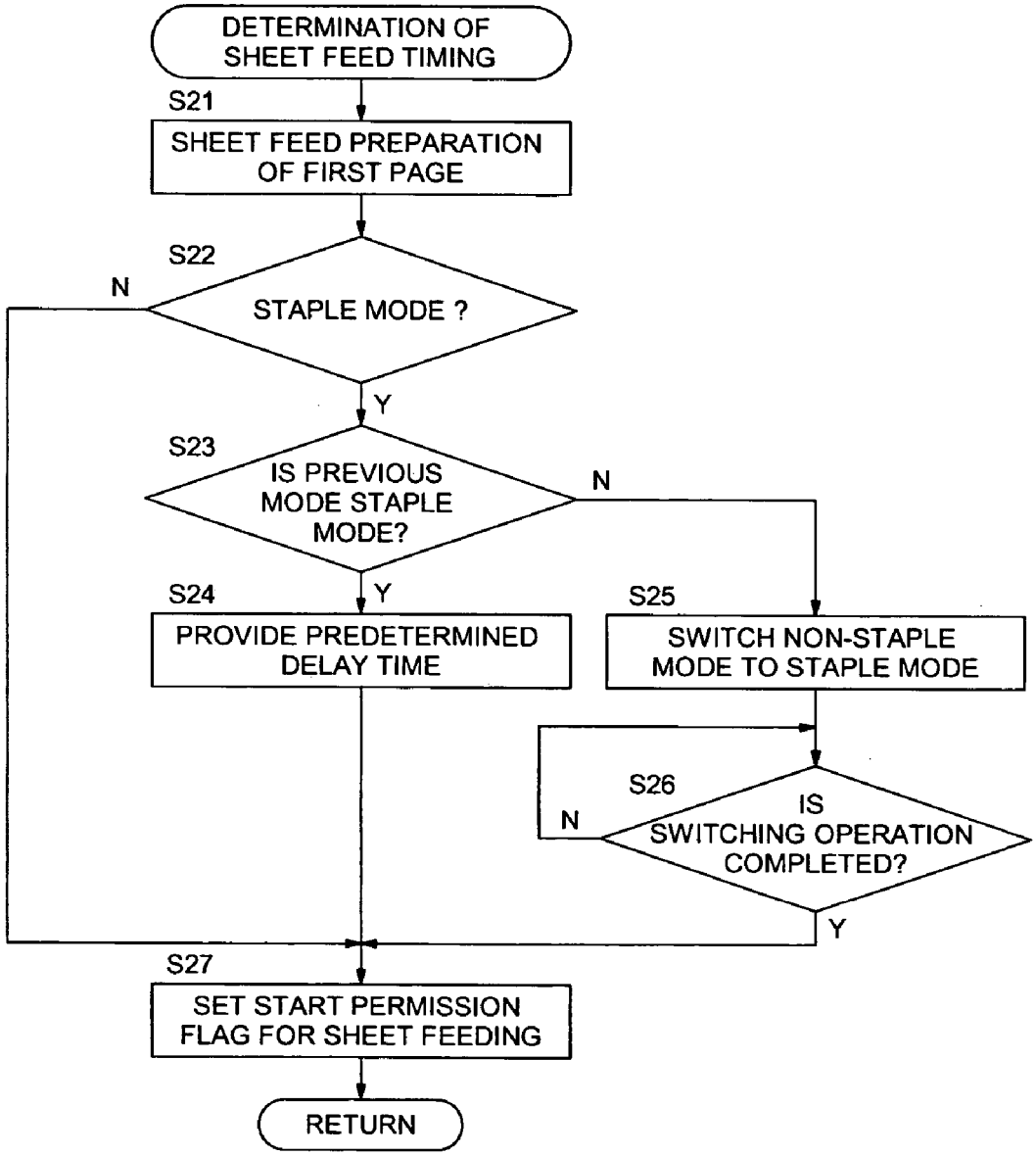
FIG. 5 is a flowchart showing the determination of sheet feed timing according to the present invention.

FIG. 5 is a flowchart showing the flow of switching between the staple mode and non-staple mode in the sheet finisher B of the present invention, and the flow of determining the sheet feed timing.

The flowchart of FIG. 5 is the same as that of FIG. 4 except that Steps S3, S4 and S5 in FIG. 4 are not present in FIG. 5. To put it more specifically, when the leading edge of the sheet P as the first page for a certain process has reached the registration roller 81 of the image forming apparatus A (Step S21), evaluation is made to see whether or not the staple mode is selected to perform the finishing process applied to the sheets P (Step S22). If the staple mode is not selected (N in Step S22), a sheet feed start permission flag is set, independently of the previous mode of processing (Step S27). This flag serves as a mark indicating permission for starting the feed of the sheets P in the wait mode. This sheet feed start permission flag is referenced during execution of the program for controlling the sheet conveyance means 8.

To put it another way, if the non-staple mode is selected, the first page of this processing is fed, independently of whether the previous mode of processing is a staple mode or not, without switching the positions of the first ejection roller 330 for handling the switching from the staple mode to the non-staple mode, and the second ejection roller 340. Thus, if the previous mode is the non-staple mode, processing in the non-staple mode continues to be performed. If the previous mode is the staple mode, a stapling process is applied to the sheets P in this processing, and they are stacked on the sheet bundle remaining in the intermediate stacker 200 without being ejected to the ejection tray.

When a predetermined number of sheets P set in this processing has been stacked, the control means C2 of the sheet finisher B controls the ejection means 300 in such a way that the aforementioned sheet bundle is integrated with the sheets P stacked thereon, which are ejected to the ejection tray 103.

Figure 6:
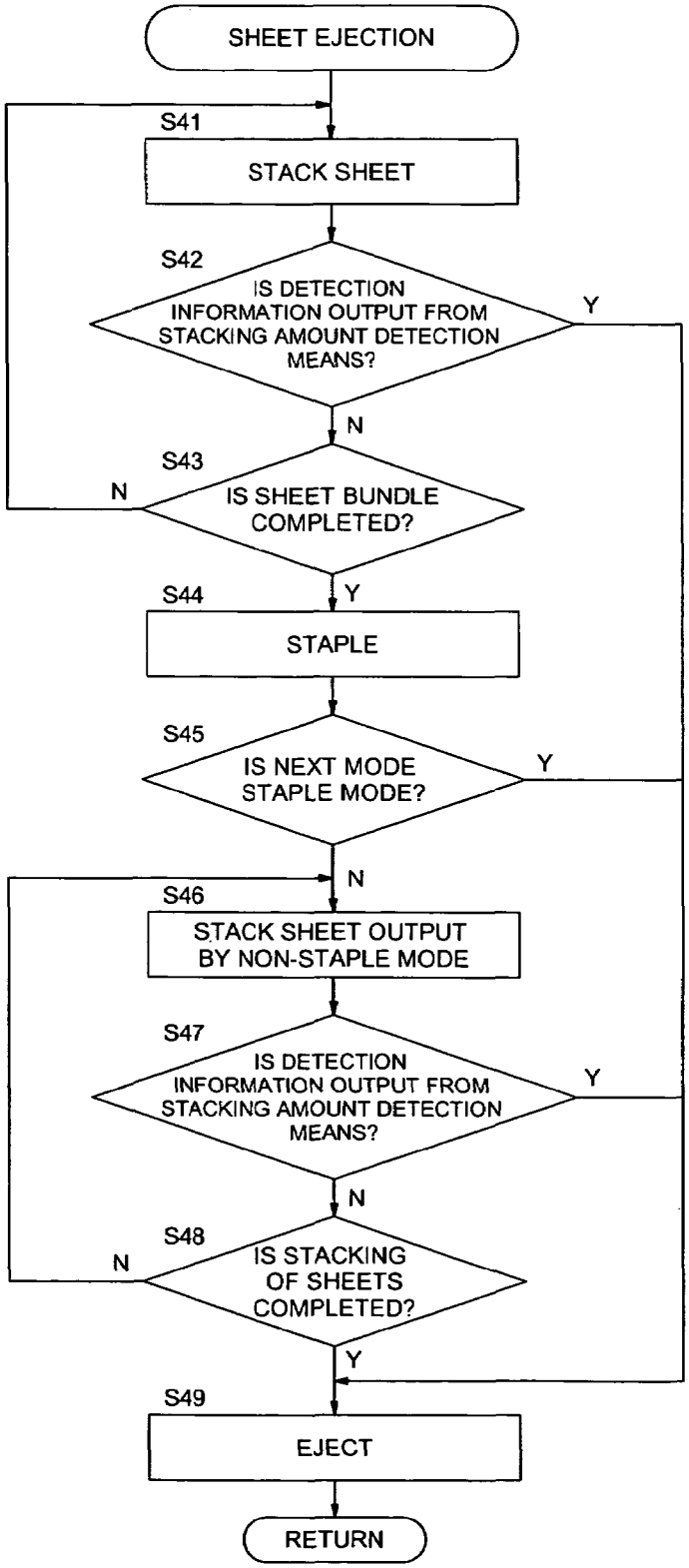
FIG. 6 is a flowchart showing the flow of ejection from the intermediate stacker.

FIG. 6 is a flowchart showing the flow of ejection the feedback sheet bundle stacked on the intermediate stacker 200, or sheet bundle and sheets.

In the first place, the sheets P to be stapled together are stacked sequentially on the intermediate stacker 200 (Step S41). If detection information has been outputted from the stacking amount detecting means S during the process of the sheets P being stacked, the control means C2 of the sheet finisher B sends the sheet feed suspension information to the control means C1 of the image forming apparatus A, whereby outputting of sheets from the image forming apparatus A is suspended. The sheet bundle stacked on the intermediate stacker 200 is ejected to the ejection tray 103, without being stapled. This procedure is performed as the control means C2 of the sheet finisher B controls the ejection means 300 (Step S49). Upon termination of processing of a predetermined number of sheet bundles without the detection information being outputted (N in Step S42; Y in Step S43), the aforementioned sheet bundle is stapled (Step S44).

If the mode of processing the sheet P fed from the image forming apparatus A is the non-staple mode (N in Step S45), the sheet P outputted in the non-staple mode is stacked on the sheet bundle (Step S46), without the stapled sheet bundle in the intermediate stacker 200 being ejected.

If the mode of processing the sheet P fed from the image forming apparatus A is the non-staple mode (N in Step S45), the sheet P outputted in the non-staple mode is stacked on the sheet bundle, without the stapled sheet bundle in the intermediate stacker 200 being ejected.

When detection information has been issued from the stacking amount detecting means S as a result of stacking of the sheet P (Y in Step S47), the outputting of the sheets from the image forming apparatus A is suspended. Then the sheet bundle stacked on the intermediate stacker 200 and the sheets are put together as one and are ejected to the ejection tray 103 (Step S49).

If the sheet bundle as sheets formed of a predetermined number of pages are stacked on the stapled sheet bundle (Y in Step S48), without the detection information being outputted from the stacking amount detecting means S, then the control means C2 controls the ejection means 300, whereby the aforementioned two sheet bundles on the intermediate stacker 200 are integrated and are ejected to the ejection tray 103 (Step S49).

As can be seen from the above description, when the processing in staple mode is followed by that in the non-staple mode, the stapled sheet bundle and non-stapled sheet bundle are ejected as one integrated bundle. This arrangement eliminates the need of switching the ejection means 300 in response to the mode change, and prevents the throughput of the sheet finisher B from being reduced due to switching time. This arrangement further allows the process of sheet finishing wherein the document partly composed of the sheet bundles to be stapled and those not to be stapled is ejected with the sheet bundles partly integrated into one.

In the present embodiment, the sheet finisher for stapling has been discussed. The present invention is also applicable to a sheet finisher quipped with a punching means for punching the sheet bundle stacked on a stacking means.

What is claimed is:

1. A sheet finisher comprising:

a sheet stacker in which sheets outputted from an image forming apparatus are stacked;

a binder which is selectively operable to bind the sheets stacked on the sheet stacker to form a bound sheet bundle;

an ejection device which ejects the sheets out from the sheet finisher;

an ejection tray on which the ejected sheets are stacked; and a controller for controlling the ejection device such that if at least one sheet which is not to be bound is outputted from the image forming apparatus while the bound sheet bundle is stacked on the sheet stacker, the bound sheet bundle is held on the sheet stacker, while the at least one sheet that is not to be bound is outputted from the apparatus and stacked on the bound sheet bundle, and such that the ejection device ejects the bound sheet bundle and the at least one sheet that is not bound stacked thereon as a unit to the ejection tray.

2. The sheet finisher of claim 1, wherein the controller controls the ejection device so that the bound sheet bundle stacked on the sheet stacker and the at least one sheet stacked thereon are ejected to the ejection tray as a unit before a first sheet of a following sheet bundle to be bound reaches the sheet stacker.

3. The sheet finisher of claim 1 further comprising a stacking amount detector for detecting whether or not an amount of the sheets stacked on the sheet stacker has reached a maximum permissible amount to be stacked;

wherein when the controller receives a signal from the stacking amount detector that the amount of the sheets stacked on the sheet stacker has reached the maximum permissible amount, the controller controls the ejection device so that the sheets stacked on the sheet stacker are ejected to the ejection tray as a unit.

4. The sheet finisher of claim 1, wherein the bound sheet bundle and the at least one unbound sheet are included in one job.

5. A control method for a sheet finisher, comprising:

stacking sheets outputted from an image forming apparatus on a sheet stacker;

selectively operating a binder to bind the sheets stacked on the sheet stacker to form a bound sheet bundle;

if at least one sheet which is not to be bound is outputted from the image forming apparatus while the bound sheet bundle is stacked in the sheet stacker, holding the bound sheet bundle on the sheet stacker while the at least one sheet that is not to be bound is outputted from the apparatus and stacked on the bound sheet bundle, and ejecting the bound sheet bundle and the at least one sheet that is not bound stacked thereon as a unit to an ejection tray.

6. A sheet finisher comprising:

a sheet stacker in which sheets outputted from an image forming apparatus are stacked;

a puncher which is selectively operable to punch the sheets stacked on the sheet stacker to form a punched sheet bundle;

an ejection device which elects the sheets out from the sheet finisher;

an ejection tray on which the elected sheets are stacked; and a controller for controlling the ejection device such that if at least one sheet which is not to be punched is outputted from the image forming apparatus while the punched sheet bundle is stacked on the sheet stacker, the punched sheet bundle is held on the sheet stacker while the at least one sheet that is not to be punched is outputted from the apparatus and stacked on the punched sheet bundle, and such that the ejection device ejects the punched sheet bundle and the at least one sheet that is not punched stacked thereon as a unit to the ejection tray.

7. The sheet finisher of claim 6, wherein the controller controls the ejection device so that the punched sheet bundle stacked on the sheet stacker and the at least one sheet stacked thereon are ejected to the ejection tray as a unit before a first sheet of a following sheet bundle to be punched reaches the sheet stacker.

8. The sheet finisher of claim 6 further comprising a stacking amount detector for detecting whether or not an amount of the sheets stacked on the sheet stacker has reached a maximum permissible amount to be stacked;

wherein when the controller receives a signal from the stacking amount detector that the amount of the sheets stacked on the sheet stacker has reached the maximum permissible amount, the controller controls the ejection device so that the sheets stacked on the sheet stacker are ejected to the ejection tray as a unit.

* * * * *